United States Patent [19]

Schumacher

[11] 4,095,742

[45] Jun. 20, 1978

[54] BALANCED SINGLE PORT THERMOSTATIC EXPANSION VALVE

[75] Inventor: Ernest W. Schumacher, Desoto, Tex.

[73] Assignee: Virginia Chemicals Inc., Portsmouth, Va.

[21] Appl. No.: 718,006

[22] Filed: Aug. 26, 1976

[51] Int. Cl.[2] ..... G05D 27/00

[52] U.S. Cl. ..... 236/92 B; 62/225; 137/505.18

[58] Field of Search ..... 236/93 B; 62/225; 251/82; 137/505.18

[56] References Cited

U.S. PATENT DOCUMENTS

| | | | |
|---|---|---|---|
| 3,087,705 | 4/1963 | Hamilton | 251/282 |
| 3,150,687 | 9/1964 | Kalle | 251/282 |
| 3,786,651 | 1/1974 | Eschbaugh et al. | 62/225 |
| 3,967,782 | 7/1976 | Eschbaugh et al. | 251/282 |

*Primary Examiner*—William E. Wayner
*Assistant Examiner*—R. J. Charvat
*Attorney, Agent, or Firm*—Depaoli & O'Brien

[57] ABSTRACT

A thermostatic expansion valve for large-capacity refrigeration systems has a pressure-balanced valve pin and no means of communicating inlet pressures to the underside of the diaphragm. The valve pin has a coaxial bore, a pair of end faces, a pair of cylindrical portions fitting slideably in a feed bore leading to an outlet chamber, a reduced stem portion of small diameter between the pair of cylindrical portions, and a pair of shoulders connecting the reduced stem portion to the pair of cylindrical portions. The shoulders are exposed to the same pressure so that the valve pin is balanced.

19 Claims, 7 Drawing Figures

BALANCED SINGLE PORT THERMOSTATIC EXPANSION VALVE

BACKGROUND OF THE INVENTION

1. Field of the Invention

This invention relates to thermostatic expansion valves for large-capacity refrigeration systems. It particularly relates to improvements in port balance of thermostatic expansion valves.

2. Review of the Prior Art

Thermostatic expansion valves, having an inlet and an outlet, a valve port therebetween, and a valve pin for selectively controlling the valve port, are well known in the art. Such valves generally comprise a compression spring for urging the valve pin or a plurality of push rods upwardly against a diaphragm of a diaphragm motor. On the upper or far side of the diaphragm is a chamber containing a sealed charge of a selected fluid which is exposed within a remote bulb to evaporated refrigerant as a temperature-sensing mechanism. In the lower or near side of the diaphragm is a chamber which is connected to the evaporated refrigerant as a pressure-sensing mechanism.

It has been known for some time that the pressure differential across the valve port produces an extraneous variable bias in the balance of forces that are intended to control the valve pin position. This bias adversely affects valve performance because of valve pin imbalance. The three basic forces intended to control valve pin position and, hence, flow through the valve are: (A) Bulb pressure, which is determined by the evaporator outlet temperature and is exerted on the top side of the valve operating diaphragm, produces a force tending to urge the valve in an opening direction as the remote bulb temperature increases;

(B) The evaporator pressure, which is exerted on the lower side of the operating diaphragm, opposes the bulb pressure and tends to urge the valve in the closing direction; and (C) The spring force, which also tends to urge the valve in the closing direction, also opposes the bulb pressure.

All other forces affecting the position of the valve pin are extraneous. It is desirable, therefore, to minimize or eliminate them. The undesirable effect of valve pin imbalance is especially significant and troublesome in large-capacity valves with their necessarily large port areas. Several methods exist in the current state of the art to balance or offset the unbalance created by a pressure differential across the port. However, existing methods create other problems such as high manufacturing costs, high valve friction, partial imbalance, high internal leakage rates through the valve port or ports, and leakage from the valve inlet to the underside of the operating diaphragm. Such leakage of inlet pressure into the lower diaphragm compartment is particularly damaging to the performance of the expansion valve.

It is also highly desirable that the valve pin, through its entire stroke, operate uniformly in accordance with the pressures exerted on the diaphragm without being influenced by extraneous pressures and unpredictable unbalance or frictional forces.

SUMMARY OF THE INVENTION

The object of this invention is to provide a thermostatic expansion valve for large-capacity refrigeration systems in which pressures on the valve pin controlling the valve port result substantially entirely from the desired balance of forces.

It is also an object to provide a thermostatic expansion valve in which leak paths from the valve inlet to the underside of the control diaphragm are eliminated.

It is an additional object to provide a thermostatic expansion valve in which flow of high-pressure fluid through leak paths from the valve inlet to the outlet, bypassing the main valve control port, is reduced.

It is further an object to povide a thermostatic expansion valve in which partially unbalancing forces caused by geometry of valve design are eliminated.

It is additionally an object to provide a thermostatic expansion valve in which high-friction seals, used to control leakage from the valve inlet to the outlet, are replaced by low-friction seals.

It is finally an object to provide a thermostatic expansion valve in which excessive valve seat leakage caused by eccentricity or misalignment of assembled parts is reduced.

In satisfaction of these objects and according to the principles of this invention, the large-capacity thermostatic expansion valve as hereinafter described comprises a valve pin having a pair of transversely disposed end faces having equal areas exposed to equal pressure differentials, a coaxial bore extending between the end faces, a cylindrical slide portion near one end face, a centrally disposed reduced-stem portion, a friction-fit portion, and a pair of shoulders at each end of the reduced-stem portion. The valve pin slidingly operates within a bore which is coaxially disposed within the thermostatic expansion valve and which intersects an inlet passage connecting to an inlet fitting.

The coaxial bore in the valve body has a blind upper end and terminates at its other end in an accurately machined circular lip in a circular recess along one wall of an outlet chamber within which a valve pin carrier moves freely. This valve pin carrier is tightly attached to the valve pin and has a circumannular shoulder which is contacted on one side by a compression spring and on the other side by a plurality of push rods. The compression spring also bears against a threadably adjusted lower spring support. The push rods fit closely within rod bores in the valve body and bear against a buffer plate which bears against or is attached to the diaphragm.

DESCRIPTION OF THE PREFERRED EMBODIMENTS

Figure 1:
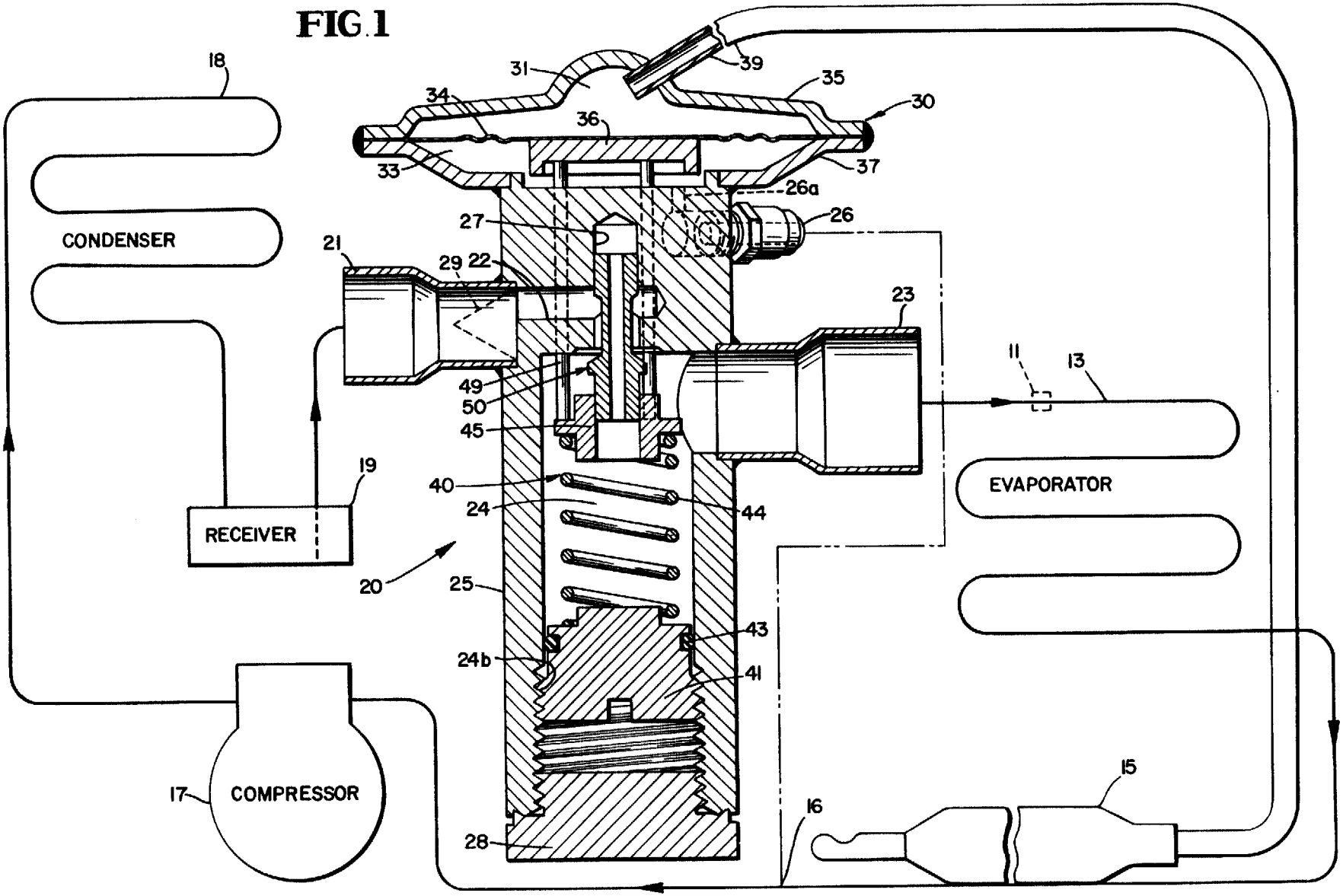
FIG. 1 is a schematic view of a large-capacity refrigeration system in which the flow of refrigerant is controlled by the thermostatic expansion valve of this invention in which the remote bulb and the external equalizer are located adjacent to the flow of expanded refrigerant at the evaporator exit.

The refrigeration system shown in FIG. 1 comprises an evaporator 13, a temperature sensing bulb 15 which is positioned to sense the temperature of the evaporated fluid, a pressure tap 16 located nearby, a compressor 17, a condenser 18, a receiver 19, and a thermostatic expansion valve 20. In some instances, a refrigerant distributor 11 is also provided between the valve 20 and the evaporator 13.

The thermostatic expansion valve 20, as shown in FIGS. 1, 2, 3, and 4, comprises an inlet fitting 21, an inlet passage having walls 22, an outlet fitting 23, an outlet chamber 24, a valve body 25, an equalizer fitting 26, a coaxial feed bore having walls 27 in the valve body, a seal cap 28, an inlet strainer 29, a diaphragm motor 30, and a port control means 40. The outlet chamber 24 has sides **24*a* and is threaded at its lower end. The diaphragm motor 30, as is known in the art, comprises an upper diaphragm support 35, a lower diaphragm support 37, and a diaphragm 34 which is straddled by an opening compartment 31 and a closing compartment 33. The opening compartment 31 is connected with bulb tubing 39 to the temperature sensing bulb 15, and the closing compartment 33 is connected to the pressure tap 16 by means of suitable tubing, the equalizer fitting 26, and an internal passage 26*a***.

The port control means 40 comprises a lower spring support 41, O-ring seal 43 for the lower spring support 41, valve pin carrier 45, compression spring 44 acting between the lower spring support 41 and the valve pin carrier 45, push rods 49, and valve pin 50. The valve pin carrier 45 has a circular shoulder 47 having parallel, circumannular, and radially disposed sides which are contacted by the compression spring 44 and by push rods 49. The valve pin carrier 45 also has a coaxial bore with sides 46.

The valve pin 50 comprises a cylindrical slide portion 51, a reduced stem portion 52, a cylindrical attachment portion 53, a valve pin body 54, a pair of end faces 55, and a coaxial bore with sides 57. Sides 46 of the coaxial bore in valve pin carrier 45 are pressure fitted to cylindrical attachment portion 53 so that valve pin body 54 and valve pin carrier 45 form a unitary assembly. The reduced stem portion 52 and the walls 27 of the coaxial feed bore in the valve body 25 form an annular port passage 67 which leads to port 69 between shoulder 63 and circular sealing lip 65 in circular recess 64.

Figure 4:
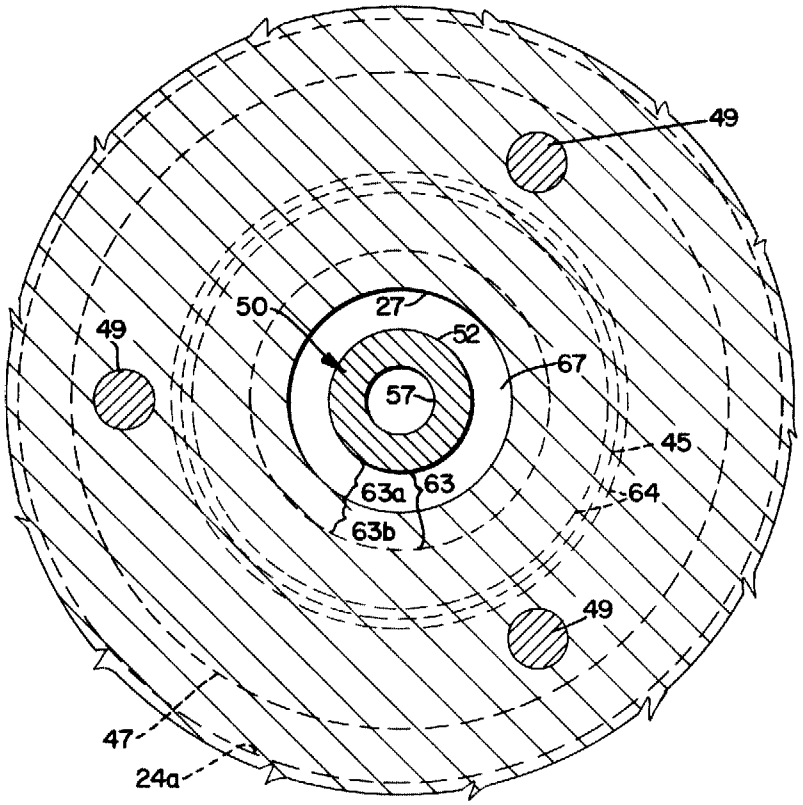
FIG. 4 is a sectional view taken along lines 4—4 in FIG. 3.

Pin shoulder 63 is at one end of reduced stem portion 52; balancing shoulder 61 is at the other end thereof. Shoulder 63 consists of a pressure portion **63*a* and a dispersal portion 63*b*, as shown in FIG. 4. Pressure portion 63*a* is exactly equal to shoulder 61. Approximate balance can be maintained with approximate areas, the degree of unbalance being directly related to the difference in areas 63*a* and 61. Consequently, when the valve pin 50 is in the position shown in FIG. 3, the inlet pressure to the valve 20 is exerted on the valve pin 50 over identical areas but in opposite directions, thereby balancing the valve pin 50 by causing the valve inlet pressure to be exerted on equal areas of the shoulders 61, 63 and the valve outlet pressure to be exerted on equal areas of both end faces 55 through coaxial bore 57 of the valve pin 50 shown in FIGS. 1–4. However, every surface on the lower portion of valve pin body 54 and on valve pin carrier 45 that is actively exposed to the outlet pressure and has an equivalent projected area in parallel to upper end face 55 provides a longitudinally directed force that balances the force directed against the upper end face 55 so that equality of area for the pair of end faces 55** is irrelevant.

The annular relationship of the shoulder 63 to the surface of the reduced stem portion 52 is preferably measured by the included pin angle 59 which selectively varies from 30° to 180°. A flat seated valve having an included angle of 180° is generally not desirable, because it is difficult to make a tight seal. A 30° angle is at the other limit because the pin tends to stick in the port.

Such adjustment of the included angle for the shoulder 63 can effect a considerable change in valve capacity. For example, a thermostatic expansion valve having a capacity of 30 tons with a 90° included pin angle can be brought to as low as 12 tons by included-angle adjustment.

Because the stroke of a thermostatic expansion valve is fixed, further change in valve capacity must be accomplished in other ways. For example, a parabolic restrictor plug or the like can be inserted into the valve port 69, thereby reducing the capacity to as low as 6 tons. Machining the surface of shoulder 63 or of circular lip 65 to a convex, concave, or parabolic surface is also a practical way to obtain desirable flow characteristics for port 69 and to alter valve capacity and the opening and closing characteristics of the port 69.

Figure 5:
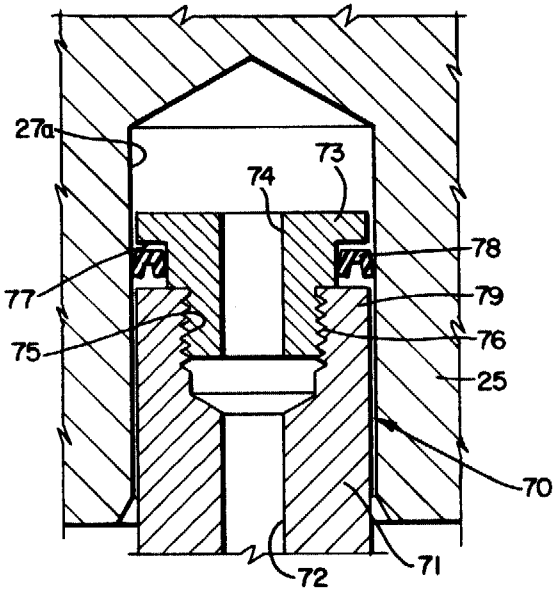
FIG. 5 is a detailed view of another embodiment of the valve pin in which plastic seals are employed in the slide portion thereof.

Embodiment 70, which is shown in FIG. 5, comprises a valve pin body 71, a cap 73, and a seal ring member 78. The valve pin body 71 has a coaxial bore with sides 72 and terminates in a recess formed by circular shoulder 79 having internal threads 75. The cap 73 has a coaxial bore with sides 74, circular shoulders 77, and external threads 76. The cap 73 is threadably inserted into the recess in valve pin body 71, forming a circular groove into which a plastic seal ring member 78, manufactured from low-friction fluorocarbon polymers, is fitted. Preferably, a U-cap seal (as shown in FIG. 5) or a lip seal is used. This seal embodiment permits employment of conventional manufacturing methods and allows larger machining tolerances for sides **27*a* of bore 27 to be used for valve body 25** while reducing leakage rates.

Figure 6:
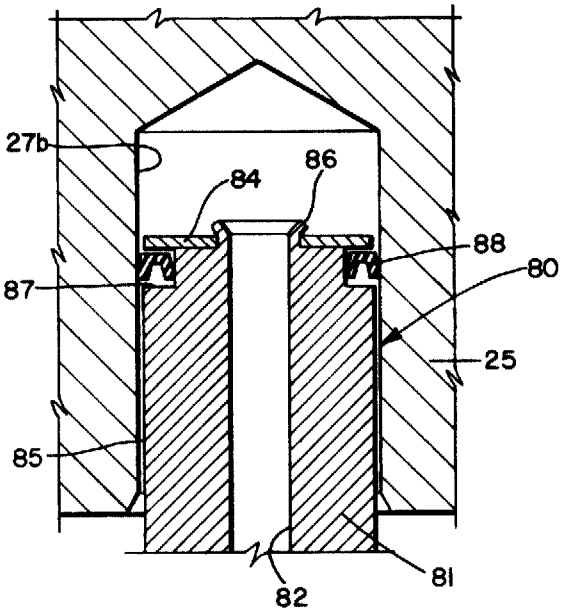
FIG. 6 is a detailed view of still another embodiment of the valve pin, using a simpler form of retension of the plastic seal in the slide portion thereof.

The valve pin embodiment 80, which is shown in FIG. 6, comprises a valve pin body 81, a washer disc 84, and a seal ring member 88. The valve pin body 81 has a coaxial bore with sides 82, a cylindrical slide portion 85, a circular terminal lip 86 at the terminal edge of the bore, and a circular recess 87 in the outer terminal edge of the body 81. The cylindrical slide portion 85 need not fit very closely against side **27*b* of the coaxial bore within body 25 but may be manufactured according to larger machining tolerances. A plastic seal ring member 88, manufactured from low-friction fluorocarbon polymers, is inserted into the recess 87. Preferably, a U-cup seal (as shown in FIG. 6) or a lip seal is used. A washer disc 84 is placed over lip 86, prior to outwardly deforming lip 86, for retaining seal 88 in circular recess 87**. This seal embodiment also reduces leakage rates and permits larger machining tolerances and conventional manufacturing methods to be employed.

Figure 7:
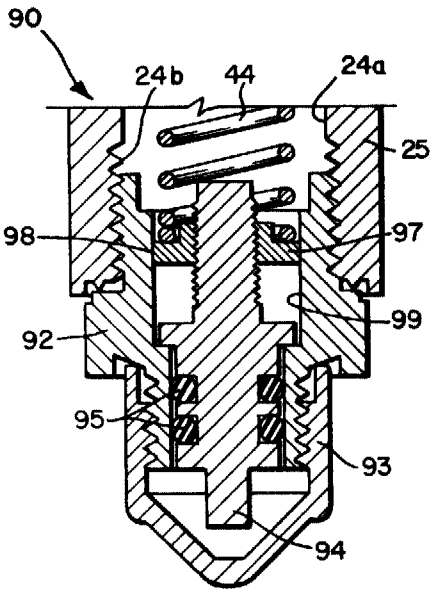
FIG. 7 is a detailed sectional view showing the valve body with an alternate embodiment for spring adjustment.

The alternate embodiment 90 for spring adjustment, shown in FIG. 7, is used with the same body 25 having the same outlet chamber 24 with sides **24*a* and internal threads 24*b* into which compression spring 44 fits as it bears against valve pin carrier 45 (not shown in FIG. 7). The embodiment 90 comprises an outwardly threaded cylindrical collar 92, a cap 93 which is screwed onto the lower threads of cylindrical collar 92, a non-rising positioning member 94 fitting within the cylindrical collar 92 and resting upon an internal shoulder thereof, a lower spring support 97, and a pair of O-ring seals 95. The positioning member 94 comprises a turning lug at the lower end, a pair of circular recesses, a circular outer shoulder, and an outwardly threaded upper stem. The lower spring support 94 has a shoulder which engages compression spring 44 and a coaxial bore with internal threads with which it is attached to the stem of positioning member 94. The O-ring seals 95 fit into the pair of circular recesses in the positioning member 94 and bear against the inner side of collar 92. By removing the cap 93, the turning lug of positioning member 94 can be moved to adjust the position of lower spring support 97. Lower spring support 97 is prevented from rotating during adjustment of positioning member 94 because its outer surface 98 is square or hexagonally shaped and is fitted into socket 99 which is similar in shape. This alternate method of spring adjustment provides an optional means for more conveniently adjusting the compression of spring 44 and thus adjusting the pressure on diaphragm 34**.

The thermostatic expansion valve as hereinbefore described provides means for causing the inlet pressure to the valve to be exerted on the valve pin over identical areas but in opposite directions, this balancing being accomplished by causing the valve outlet pressure to be exerted on equal areas at both ends of the valve pin 50 through its bore. This invention eliminates the leak path from the valve inlet to the underside of the control diaphragm. Further, it reduces the leak path from the valve inlet to the outlet which bypasses the main valve control port. In addition, it eliminates partial imbalance due to geometry of valve design, reduces high friction seals used to control leakage in the leak paths from the valve inlet to the underside of the control diaphragm and from the valve inlet to the outlet which bypasses the main valve control port. Further, it reduces high manufacturing costs and excessive valve seat leakage caused by eccentricity or misalignment of assembled parts.

If the refrigerant distributor 11 is present in the system, the pressure drop through distributor 11 and the evaporator 13 may be from 10 to 70 psi. Consequently, the pressure tap 16 must necessarily be located beyond the evaporator 13 and fairly close to temperature sensing bulb 15 so that both measure the same conditions. If, however, there is no refrigerant distributor 11 in the system, the pressure tap 16, outlet fitting 26, and connecting tubing can be omitted; instead, passage **26*a* can be extended to connect with chamber 24** as an internal equalizer.

Push rods 49 must fit with reasonable tightness in their respective bores in valve body 25. However, leakage from outlet chamber 24 to closing compartment 33 is not a serious matter. By this design, there is no possibility of leakage of fluid at inlet pressure to closing compartment 33.

Figure 2:
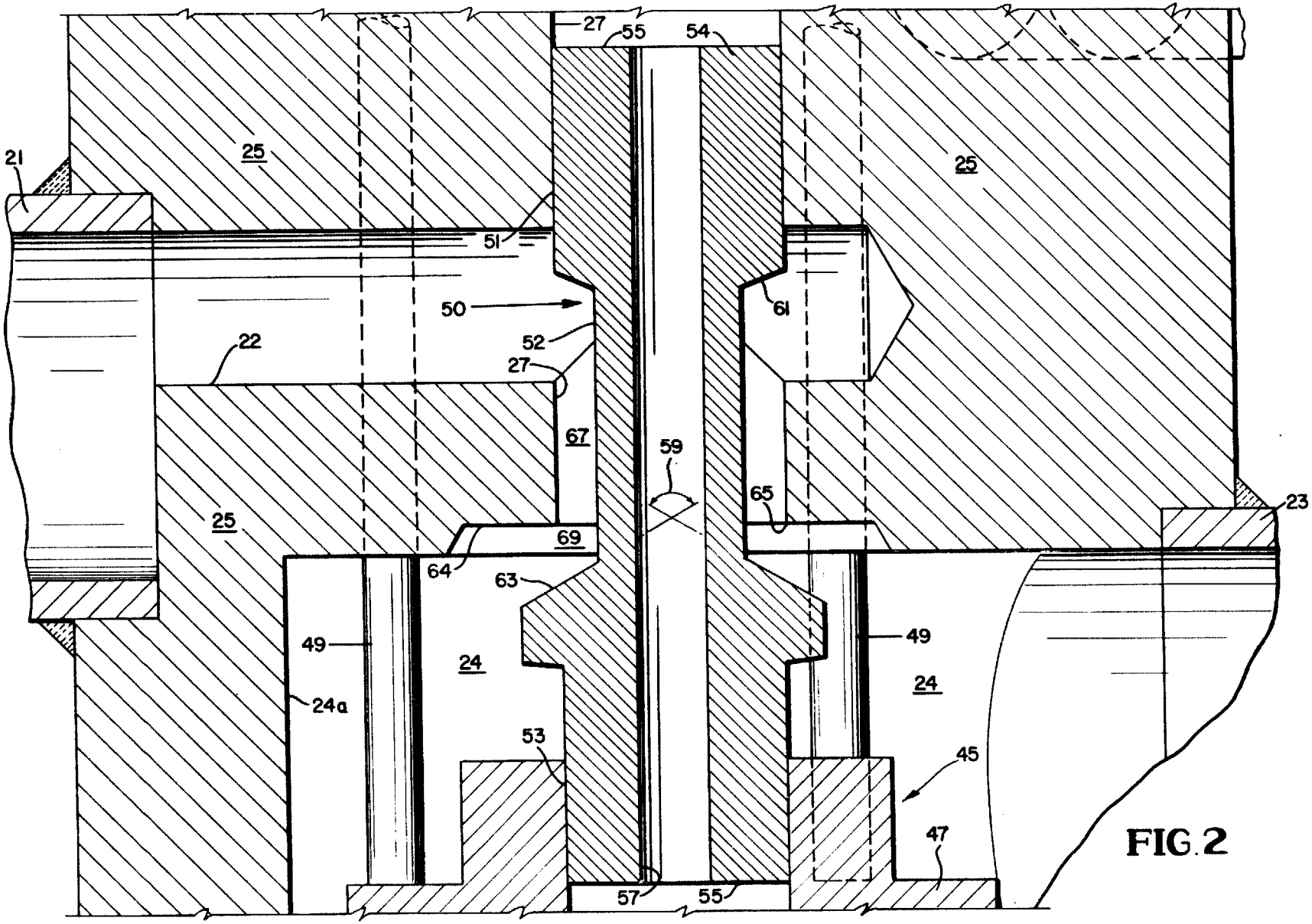
FIG. 2 is an enlarged sectional elevation of the valve as shown in FIG. 1, with the valve pin in open position.
Figure 3:
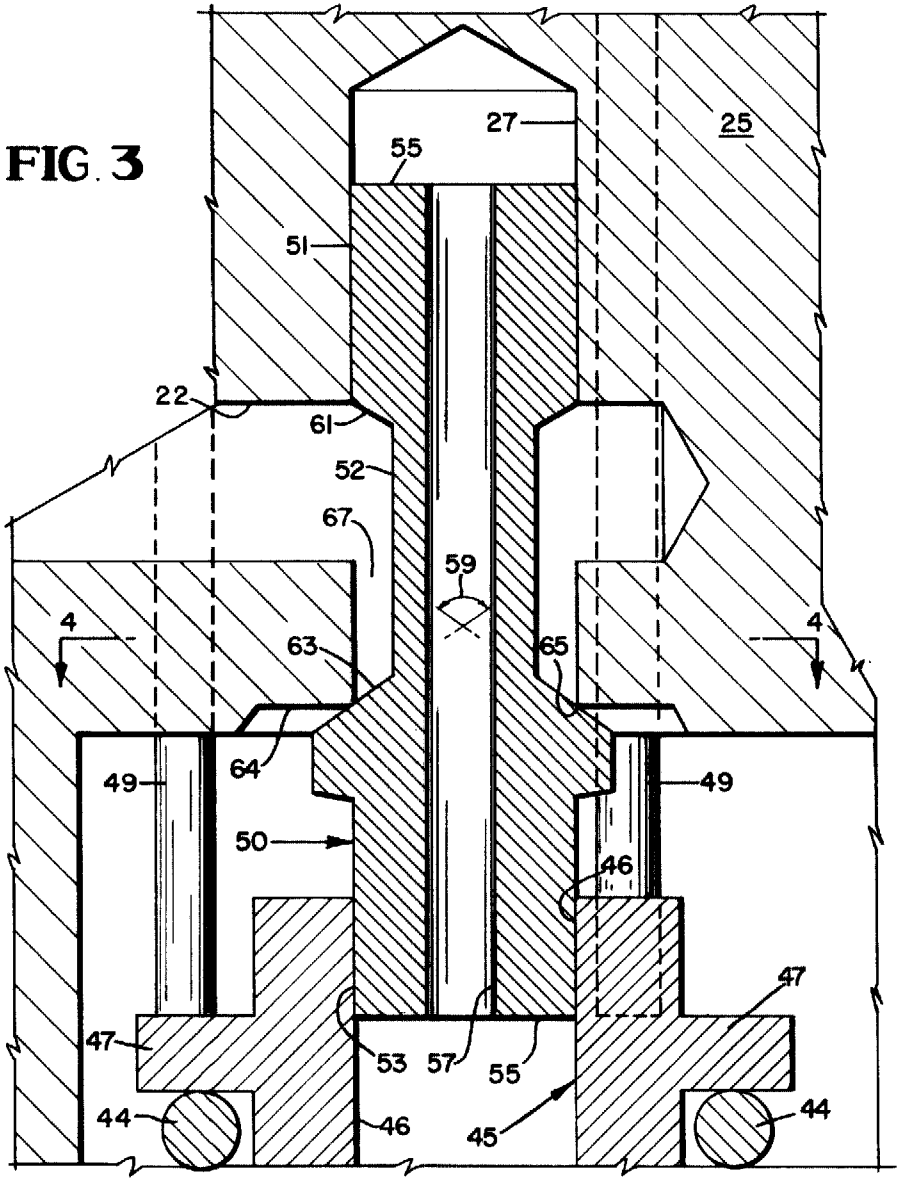
FIG. 3 is a similar view with the valve pin in closed position.

Leakage of fluid at inlet pressure into outlet chamber 24, by way of the fit between cylindrical slide portion 51 and the sides 27 of the coaxial feed bore in the valve body 25, is another matter. As shown in FIGS. 2 and 3, this is a sliding fit, requiring very accurate machining. More practical and less expensive devices for achieving the necessary tightness of sealing are shown in FIGS. 5 and 6. Both embodiments employ conventional methods and permit larger machining tolerances while reducing leakage rates.

It is to be understood that the invention is not to be restricted to the specific embodiments described hereinbefore because numerous other embodiments can be constructed according to the principles of this invention. What is to be construed at the invention according to the scope thereof is defined solely by the accompanying claims.

What is claimed is:

1. In a thermostatic expansion valve having a cylindrical feed bore, having a blindered, connected to an inlet means for admitting refrigerant at inlet pressures, the improvement comprising a valve pin having a lesser end portion and a greater end portion, a reduced stem portion therebetween, a lesser shoulder and a greater shoulder respectively connecting said lesser end portion and said greater end portion to said reduced stem portion, a pair of end faces, and a coaxial bore connecting said pair of end faces to each other and to an outlet chamber in said thermostatic expansion valve, said lesser end portion fitting slideably within said cylindrical feed bore and said greater shoulder forming a valve port in combination with said feed bore, between said inlet pressure in said feed bore and outlet pressure in said outlet chamber.

2. The improvement in the thermostatic expansion valve of claim 1, wherein said lesser shoulder and said greater shoulder have a selected angle of inclination to said reduced stem portion, the included pin angle for measuring said selected angle of inclination being from 30° to 180°.

3. The improvement in the thermostatic expansion valve of claim 2, wherein said lesser shoulder and said greater shoulder have equal circumannular cross-sectional areas exposed to said inlet pressure when said valve port is closed, whereby said valve pin is acted on substantially only by differences in pressure upon a diaphragm of a diaphragm motor.

4. The improvement in the thermostatic expansion valve of claim 3, wherein said valve pin is tightly attached to a valve pin carrier which is freely moveable under control of a compression spring and a plurality of push rods which bear upon said diaphragm and upon said valve pin carrier.

5. The improvement in the thermostatic expansion valve of claim 1, wherein said valve port comprises a parabolic restrictor plug.

6. The improvement in the thermostatic expansion valve of claim 1, wherein said greater shoulder is machined to a surface selected from the group consisting of convex, concave, and parabolic surfaces.

7. A thermostatic expansion valve, comprising:

A. a valve body having an inlet passage, an outlet chamber, and a feed bore which is connected to said inlet passage, has a blind end, and terminates in a circular sealing lip adjacent to said outlet chamber;

B. a diaphragm motor having a diaphragm straddled by an opening compartment and a closing compartment;

C. a port control means, comprising:

(1) a lower spring support, (2) a valve pin carrier which is freely movable within said outlet chamber, (3) a compression spring acting between said lower spring support and said valve pin carrier, (4) a plurality of push rods acting between said diaphragm and said valve pin carrier, and (5) a valve pin, having:

(a) a cylindrical slide portion which fits slideably within said feed bore, (b) a cylindrical attachment portion which is attached to said valve pin carrier, (c) a reduced stem portion which is disposed between said cylindrical slide portion and said cylindrical attachment portion to form an annular port passage within said feed bore, (d) a pair of shoulders, having equal circumannular cross-sectional areas exposed to inlet pressure, which straddle said reduced stem portion and circumannularly connect said cylindrical slide portion and said cylindrical attachment portion to said reduced stem portion, (e) a pair of end faces, and (f) a longitudinally disposed bore connecting said end faces to outlet pressure.

8. The thermostatic expansion valve of claim 7, wherein said pair of shoulders have the same angle of inclination to said reduced stem portion.

9. The thermostatic expansion valve of claim 7, wherein said shoulders have a selected angle of inclination to said reduced stem portion, said angle of inclination being measured by an included pin angle of 30° to 180°.

10. The thermostatic expansion valve of claim 7, wherein said cylindrical slide portion comprises a U-cup seal.

11. The thermostatic expansion valve of claim 7, wherein said cylindrical slide portion comprises a lip seal.

12. The thermostatic expansion valve of claim 7, wherein said cylindrical attachment portion is tightly attached to said valve pin carrier.

13. The thermostatic expansion valve of claim 12, wherein said valve pin carrier comprises a circumannular shoulder on one side of which said compression spring bears and on the other side of which said push rods bear.

14. The thermostatic expansion valve of claim 13, wherein said valve includes no means for communicating inlet pressures to said closing compartment.

15. The thermostatic expansion valve of claim 14, wherein said closing compartment is connected by means of an external equalizer to the pressure of evaporated refrigerant fluid.

16. In a thermostatic expansion valve having a cylindrical feed bore connected to an inlet means for admitting refrigerant at inlet pressures, the improvement comprising a valve pin having:

(A) a lesser end portion, a greater end portion, and a reduced stem portion therebetween;

(B) a means for balancing said inlet pressures upon said valve pin, comprising a lesser shoulder and a greater shoulder respectively connecting said lesser end portion and said greater end portion to said reduced stem portion; and (C) a means for balancing outlet pressures upon said valve pin, comprising a pair of end faces and a coaxial bore connecting said pair of end faces to each other and to an outlet chamber in said thermostatic expansion valve.

17. In a thermostatic expansion valve having a cylindrical feed bore connected to an inlet means for admitting refrigerant at inlet pressures, the improvement comprising a valve pin having:

(A) a lesser end portion, a greater end portion, and a reduced stem portion therebetween, said lesser end portion fitting slideably within said cylindrical feed bore;

(B) a means for balancing inlet pressures upon said valve pin, comprising a lesser shoulder and a greater shoulder respectively connecting said lesser end portion and said greater end portion to said reduced stem portion;

(C) a means for balancing outlet pressures upon said valve pin, comprising a pair of end faces and a coaxial bore connecting said pair of end faces to each other and to an outlet chamber in said thermostatic expansion valve, and (D) a means for reducing valve seat leakage caused by eccentricity or misalignment of assembled parts, comprising:

(1) a circular sealing lip which is formed by the juncture of said outlet chamber with said cylindrical feed bore, the juxtaposition of said greater shoulder and said circular sealing lip forming a valve port; and (2) an inclination of said greater shoulder that conically disperses fluid from said feed bore into said outlet chamber, said inclination being measured as an included pin angle that is selected from the range of more than 30° to less than 180°.

18. The improvement in the thermostatic expansion valve of claim 17, wherein said greater shoulder is provided with a dispersal portion over which said fluid is conically dispersed into said outlet chamber.

19. In a thermostatic expansion valve having a cylindrical feed bore connected to an inlet means for admitting refrigerant at inlet pressure, the improvement comprising a valve pin having a lesser end portion and a greater end portion, a reduced stem portion therebetween, a lesser shoulder and a greater shoulder respectively connecting said lesser end portion and said greater end portion to said reduced stem portion, a pair of end faces, and a coaxial bore connecting said pair of end faces to each other and to an outlet chamber in said thermostatic expansion valve, whereby said valve pin is balanced with respect to outlet pressure, said lesser end portion fitting slideably within said cylindrical feed bore and said greater shoulder forming a valve port, in combination with said feed bore, between said inlet pressure in said feed bore and said outlet pressure in said outlet chamber, said greater end portion being freely moveable within said outlet chamber and spaced from the sides thereof, said greater shoulder having a selected angle of inclination to said reduced stem portion, the included pin angle for measuring said selected angle of inclination being more than 30° and less than 180°, so that said greater shoulder centers said valve pin and reduces valve seat leakage caused by eccentricity or misalignment of assembled parts when said greater shoulder seats itself against said circular sealing lip, and said lesser shoulder and said greater shoulder have equal circumannular cross-sectional areas exposed to said inlet pressure when said valve port is closed, whereby said valve pin is balanced with respect to said inlet pressure and is acted on substantially only by differences in pressure upon a diaphragm of a diaphragm motor.

* * * * *